US011255192B2

(12) United States Patent
Beard et al.

(10) Patent No.: US 11,255,192 B2
(45) Date of Patent: Feb. 22, 2022

(54) PICK SLEEVE

(71) Applicants: Gavin James Beard, Irene (ZA); Mark Forsyth, Parkhaven (ZA)

(72) Inventors: Gavin James Beard, Irene (ZA); Mark Forsyth, Parkhaven (ZA)

( * ) Notice: Subject to any disclaimer, the term of this patent is extended or adjusted under 35 U.S.C. 154(b) by 0 days.

(21) Appl. No.: 16/981,394

(22) PCT Filed: Mar. 14, 2019

(86) PCT No.: PCT/IB2019/052084
§ 371 (c)(1),
(2) Date: Sep. 16, 2020

(87) PCT Pub. No.: WO2019/180554
PCT Pub. Date: Sep. 26, 2019

(65) Prior Publication Data

US 2021/0003007 A1 Jan. 7, 2021

(30) Foreign Application Priority Data

Mar. 22, 2018 (ZA) ..... 2018/01900

(51) Int. Cl.
*E21C 35/18* (2006.01)
*E21C 35/197* (2006.01)

(52) U.S. Cl.
CPC ..... *E21C 35/197* (2013.01); *E21C 35/188* (2020.05)

(58) Field of Classification Search
CPC ..... E21C 35/18; E21C 35/183
See application file for complete search history.

(56) References Cited

U.S. PATENT DOCUMENTS 5,931,542 A * 8/1999 Britzke ..... E21C 35/197 299/104
7,992,945 B2 * 8/2011 Hall ..... E21C 35/183 299/111
2003/0137185 A1 * 7/2003 Sollami ..... E21C 35/197 299/106
2008/0036280 A1 * 2/2008 Hall ..... E21B 10/55 299/105
2009/0091177 A1 4/2009 Moore
(Continued)

FOREIGN PATENT DOCUMENTS

EP 0160757 11/1985
EP 3183425 6/2017
(Continued)

OTHER PUBLICATIONS

International Search Report and Written Opinion for International (PCT) Patent Application No. PCT/IB2019/052084, dated Apr. 19, 2019, 8 pages.
(Continued)

*Primary Examiner* — Janine M Kreck
(74) *Attorney, Agent, or Firm* — Sheridan Ross P.C.

(57) ABSTRACT

The invention relates to a pick sleeve (10) including a head (12) and a shank (14). The head (12) includes a central part (20) and a bearing member (22) which is secured to the central part (20). The bearing member (22) is separable from the central part (20) in order to facilitate removal of the pick sleeve (10) from a holder (38). The invention extends to a tool (50) which is used in the removal of the pick sleeve (10) from the holder (38).

8 Claims, 10 Drawing Sheets

(56) References Cited

U.S. PATENT DOCUMENTS

| | | | | |
|---|---|---|---|---|
| 2010/0295360 | A1* | 11/2010 | Kramer | E21C 35/197 299/110 |
| 2011/0241407 | A1* | 10/2011 | Fader | E21C 35/197 299/29 |
| 2016/0102550 | A1* | 4/2016 | Paros | E21C 35/197 299/113 |

FOREIGN PATENT DOCUMENTS

| | | |
|---|---|---|
| WO | WO 00/34626 | 6/2000 |
| WO | WO 2011/101612 | 8/2011 |
| WO | WO 2016/026725 | 2/2016 |

OTHER PUBLICATIONS

Official Action for India Patent Application No. 202047044367, dated Jul. 23, 2021, 6 pages.

* cited by examiner

PICK SLEEVE

CROSS REFERENCE TO RELATED APPLICATIONS

This application is a national stage application under 35 U.S.C. 371 and claims the benefit of PCT Application No. PCT/IB2019/052084 having an international filing date of 14 Mar. 2019, which designated the United States, which PCT application claimed the benefit of South Africa Patent Application No. 2018/01900 filed 22 Mar. 2018, the disclosure of each of which are incorporated herein by reference.

This invention relates to mining. More particularly it relates to a pick sleeve. It further relates to a method of and a tool for use in removing a pick sleeve from a pick sleeve holder.

The Inventors are aware of mining equipment which includes a rotating cutter head to which a plurality of picks is mounted at spaced apart positions. The cutter head includes a plurality of holders or cutter boxes fixed thereto at spaced-apart positions, typically by welding, and to which the picks are mountable. In view of the substantial wear which is encountered, the picks have a limited working life and need to be replaced at regular intervals. The picks typically include a tapered head and a shank connected to and protruding from the head. In order to prevent excessive wear on the holders or boxes, pick sleeves are typically mounted in the boxes and the picks are mounted to the sleeves.

The sleeves include a head and an elongate shank protruding from the head. A bore extends through the head and the shank. The shank of the pick is received in the bore in the sleeve and retained in position by a spring clip.

The head of the pick sleeve is such that its lateral dimensions increase away from a leading end of the sleeve and the shank protrudes from a trailing end of the head. In use, the shank of the sleeve is received as an interference or friction fit in a complementary bore in the holder and the trailing end of the head from which the shank protrudes forms a seat which abuts against a complementary surface of the associated holder and inhibits relative axial movement of the sleeve in the holder. The dimensions of the head are selected such that its trailing end has a diameter which corresponds substantially to that of the holder and serves to deflect material dislodged by the pick away from the holder to inhibit abrasive wear on the holder.

The picks are the primary wear elements and require regular replacement. However, at least the heads of the sleeves are subjected to wear, sometimes referred to as metal wash, and in order to reduce the risk of wear or damage to the holders the sleeves need to be replaced periodically, albeit less frequently than the picks.

However, by virtue of the tight fit of the shank of the sleeve in the associated holder as well as the structure of the cutting head difficulties can be encountered in removing a worn sleeve from the associated holder. One way in which the sleeves are removed involves the use of expensive and sophisticated equipment which is not particularly suited to the harsh environment encountered particularly in a mine. A trailing or free end of the shank of the sleeve typically protrudes from an end of the holder and another way in which the sleeves are removed is to hit the free end with a hammer. By virtue of the structure of the cutter head it is not always easy to get access to the trailing or free end of the sleeve with a hammer. In addition from a safety perspective is not desirable that the sleeve be removed by using a hammer since this can lead to injuries to personnel and the regeneration of sparks which in an environment such as a coal mine could be extremely dangerous.

It is an object of this invention to provide means which the Inventors believe will at least ameliorate these problems.

According to one aspect of the invention there is provided a pick sleeve which includes:

- a head which includes a central part having an outer surface and a bearing member which is secured to the central part and disconnectable therefrom and which defines a bearing surface through which a load can be applied to the bearing member;
- a shank which is connected to and protrudes from the central part of the head and which is receivable in a holder or cutter box of a mining machine; and
- an open-ended bore extending through the head and the shank within which a shank of a pick is receivable.

The bearing surface may protrude laterally beyond the outer surface of the central part In one embodiment of the invention, the central part and the bearing member may be formed as separate parts and secured together. In a preferred embodiment of the invention the bearing member is a press fit on the central part.

In another embodiment of the invention, the central part and the bearing member may be of unitary construction, i.e. they may be formed from a single piece of material. Typically, a zone of weakness will be provided between the central part and the bearing member to facilitate the disconnection of the bearing member from the central part.

The central part of the head and the shank may be of unitary construction, i.e. they may be formed as one piece.

The outer surface of the central part may be frusto-conical and taper towards a front of the head.

The bearing member may be annular and the bearing surface may be tapered and extend substantially continuously with and form an extension of the outer surface of the central part.

A rear surface of the bearing member may form a shoulder which in use abuts against a surface of the holder in which the pick sleeve is mounted.

In a preferred embodiment of the invention, a rear surface of the bearing member and a rear surface of the central part may lie in a plane which is perpendicular to a longitudinal axis of the pick sleeve and which together form a shoulder which in use abuts against a surface of the holder in which the pick sleeve is mounted.

According to another aspect of the invention, there is provided a method of removing a pick sleeve of the type described above form a pick sleeve holder or cutter box which forms part of a cutter head and which includes a tubular body within which the shank of the pick sleeve is an interference or friction fit, the method including applying oppositely disposed forces to the shank of the pick sleeve and to the bearing member which causes the bearing member to separate from the central part of the head and to withdraw the shank from body of the pick sleeve holder.

According to yet another aspect of the invention, there is provided a tool for use in removing a pick sleeve of the type described above from a pick sleeve holder or cutter box which forms part of a cutter head and which includes a tubular body within which the shank of the pick sleeve is an interference or friction fit, the tool including:

- a tensile element;
- a connecting arrangement whereby a force can be transmitted from the tensile element to the pick sleeve in a direction which urges the shank of the pick sleeve out of the pick sleeve holder;

a head engaging member which defines a contact surface configured to abut against the bearing surface of the bearing member; and a displacement arrangement whereby the tensile element and the head engaging member can be displaced relative to one another in order to apply an extraction load to the shank of the pick sleeve and displace the shank of the pick sleeve out of the pick sleeve holder.

The tensile element may be in the form of an extractor shaft.

The extractor shaft may have a proximal end and a distal end, the shaft being configured to be inserted through the bore of the pick sleeve such that the proximal end protrudes from the head of the pick sleeve and the distal end protrudes from the shank of the pick sleeve, the connecting arrangement including a shank engaging member which is dismountably mountable on the portion of the extractor shaft adjacent the distal end which protrudes from the shank and which is configured to abut against the free or trailing end of the shank to apply an axial load thereto. The shank engaging member may be in the form of a clip which is dismountably mountable on the extractor shaft.

The contact surface of the head engaging member may be annular and seat against the bearing surface of the bearing member.

In one embodiment of the invention, the displacement arrangement may include complementary screw threads provided on the extractor shaft and the head engaging member such that relative rotation between the extractor shaft and the head engaging member results in relative longitudinal displacement thereby applying oppositely disposed forces to the shank and the bearing member.

In another embodiment of the invention, relative displacement of the extractor shaft and the head engaging member may be effected hydraulically. To this end the displacement arrangement may include a hydraulically actuated piston and cylinder arrangement. The extractor shaft may be connected to the piston of the piston and cylinder arrangement and the head engaging member may be connected to or form part of the cylinder of the piston and cylinder arrangement.

The tool may include an intermediate member which defines a contact surface configured to abut against the bearing surface of the bearing member and an oppositely disposed second contact surface configured to engage a complementary contact surface on the head engaging member, the second contact surface and complementary surface on the head engaging member being part spherical in shape.

The invention will now be described, by way of example, with reference to the accompanying diagrammatic drawings.

Figure 1:
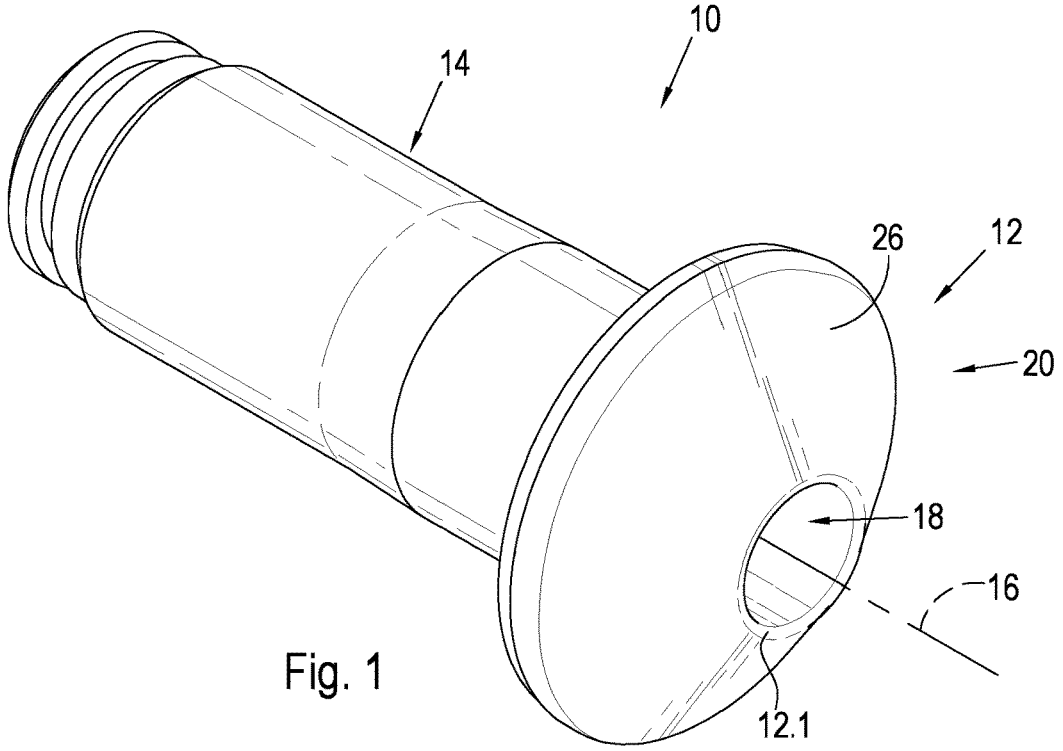
FIG. 1 shows a three-dimensional view of a pick sleeve in accordance with the invention.
Figure 2:
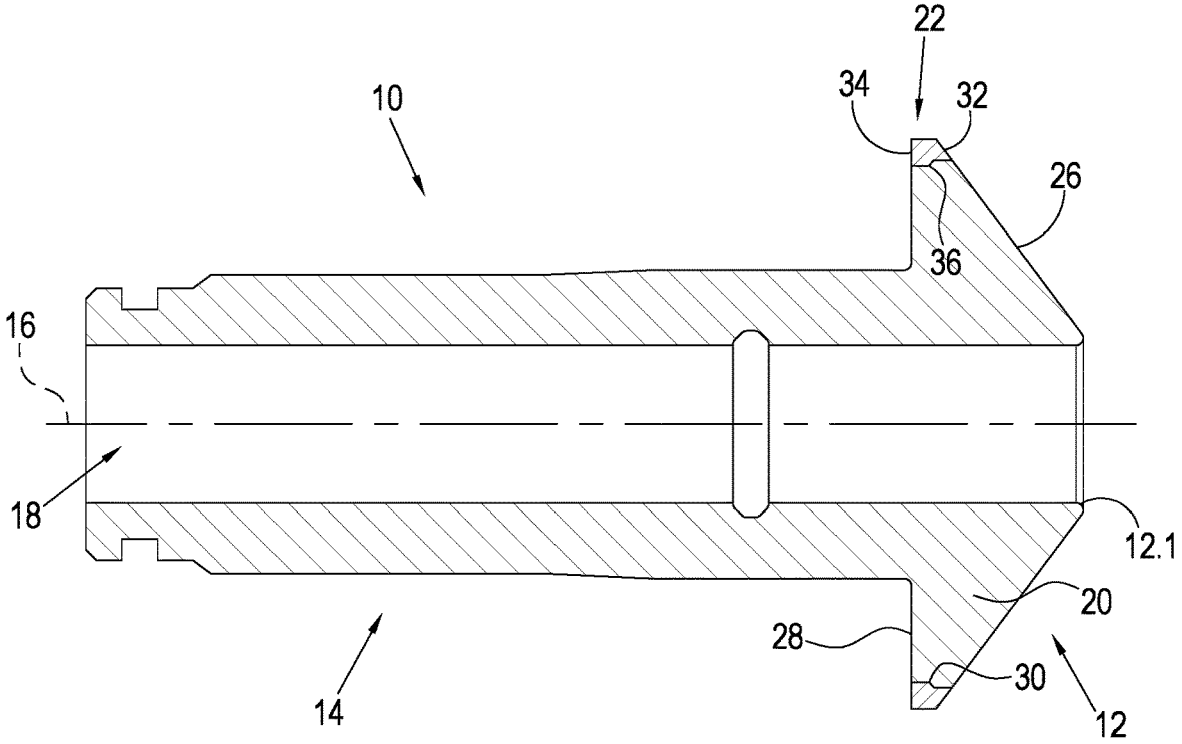
FIG. 2 shows a longitudinal sectional view of part of the pick sleeve of FIG. 1.
Figure 3:
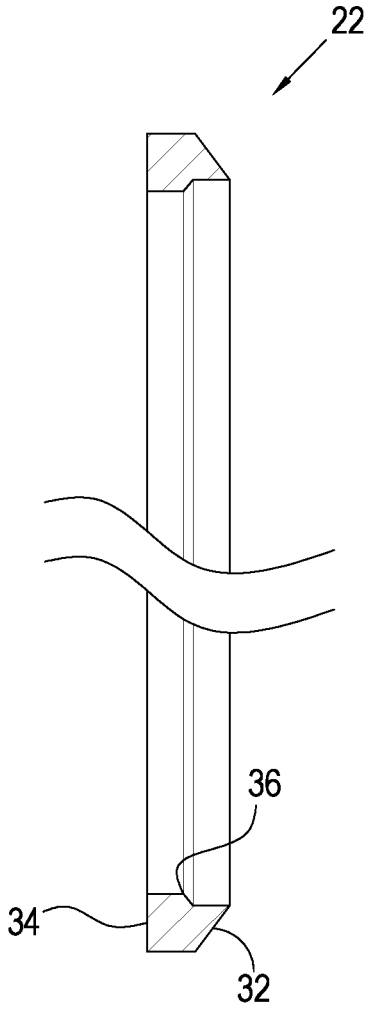
FIG. 3 shows a sectional view of a bearing member forming part of the pick sleeve of FIG. 1.

In the drawings reference numeral 10 refers general to a pick sleeve in accordance with the invention. The pick sleeve 10 includes a head, generally indicated by reference numeral 12 and a shank, generally indicated by reference numeral 14.

The sleeve 10 has a longitudinal axis 16 and a bore 18 extends axially through the pick sleeve 10 and opens out of opposed ends thereof.

The head 12 includes a central part, generally indicated by reference numeral 20 which, in the embodiment shown, is frusto-conical in shape and a bearing member, generally indicated by reference numeral 22, which is secured to the central part 20.

In the embodiment shown, the bearing member 22 is formed as a separate annular ring and is a press fit on the central part 20.

More particularly, the central part 20 has a frusto-conical front face 26 which tapers towards a front 12.1 of the head 12. The central part 20 further includes a rear face 28 which lies in a plane which Is perpendicular to the axis 16. An annular intermediate face 30 extends between the front face 26 and the rear face 28. In the embodiment shown, the intermediate face 30 includes a step.

The bearing member 22 includes a frusto-conical front face 32, a planar rear face 34 and an inner face 36 which extends between the front face 32 and the rear face 34. The inner face 36 is shaped and dimensioned to be an interference fit on the intermediate face 30. When the bearing member 32 is mounted on the central part 20, the front face 32 forms a continuation of the front face 26 and the rear face 34 is co-planar with and forms an annular extension of the rear face 28.

The shank 14 is connected to and protrudes from the rear face 28 of the central part 20 and is receivable in a holder or cutter box 38 (FIG. 4) of a mining machine in a conventional fashion.

Figure 4:
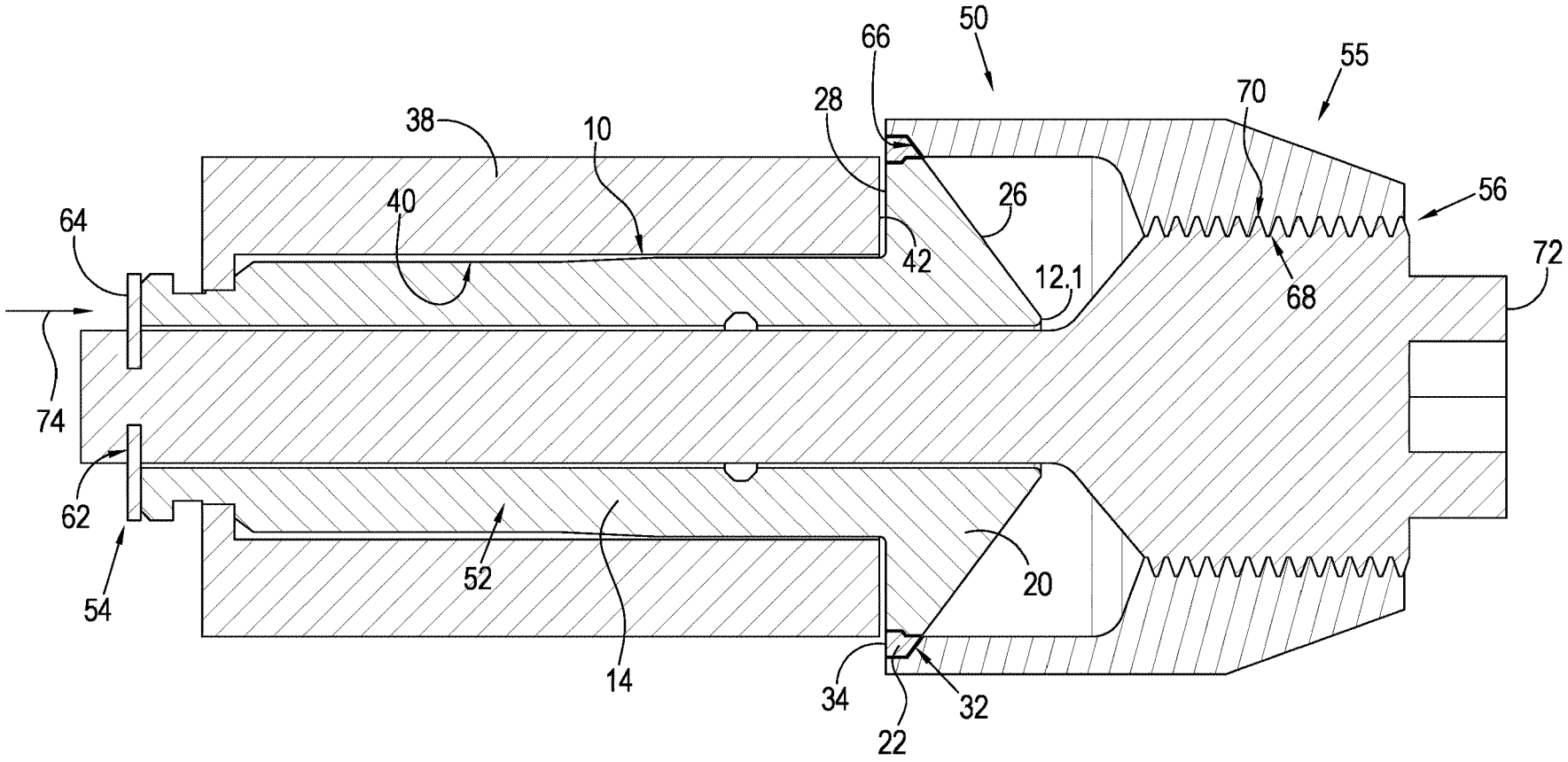
FIG. 4 shows a longitudinal sectional view of a pick sleeve in accordance with the invention being removed from a holder or cutter box of a mining machine making use of a tool for use in removing the pick sleeve in accordance with the invention.

As can best be seen in FIG. 4 of the drawings, the holder 38 is in the form of a sleeve which is secured to a surface of a rotating cutter head. When the pick sleeve 10 is mounted in the holder 38, the shank 14 extends through a bore 40 in the holder. The rear face 28 of the central part 20 and the rear face 34 of the bearing member 22 together form an annular shoulder which surrounds the shank 14 and abuts against an annular face 42 of the holder 38. A pick (not shown) is mounted in the bore 18 in a conventional fashion such that it protrudes forwardly from the head 12.

When the cutter head is rotating, the picks come into contact with and dislodge material from the material body being mined. The front faces 26 and 32 together define a surface which deflects the dislodged material away from the holder 38 to inhibit excessive wear on the holder.

When the pick is worn, it is removed from the pick sleeve 10 in a conventional fashion and replaced with a fresh pick.

Figure 5:
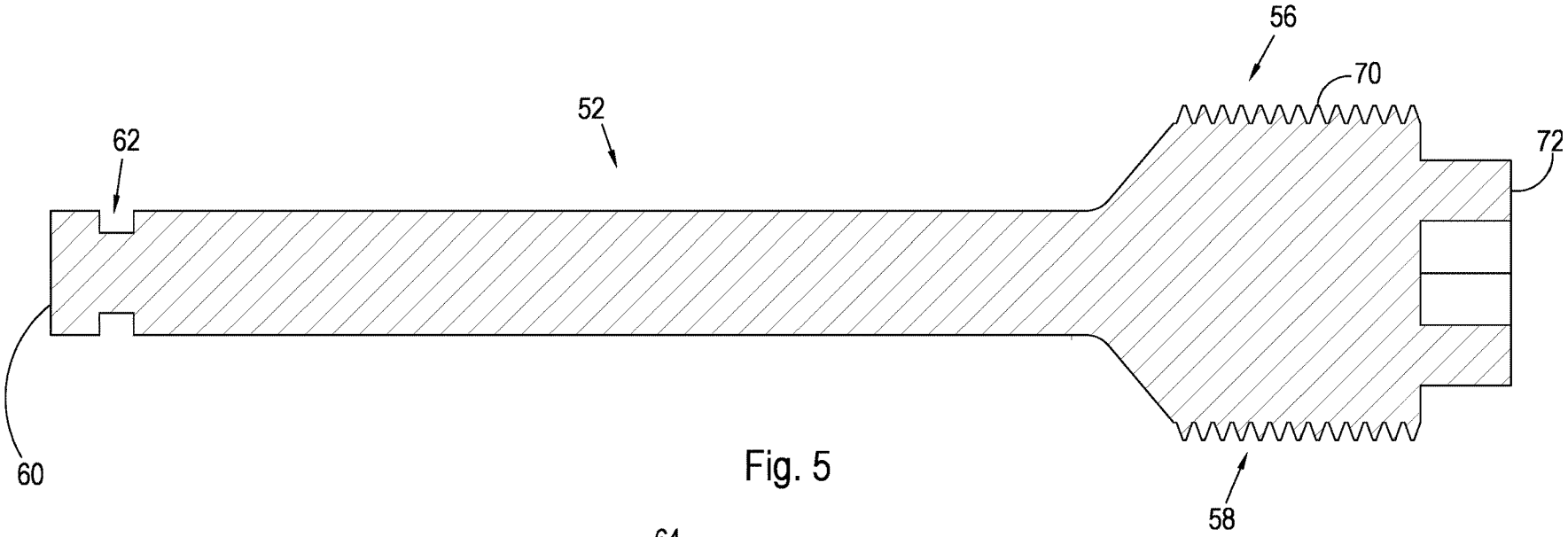
FIG. 5 shows a longitudinal sectional view of an extractor shaft which forms part of the tool of FIG. 4.
Figure 6:
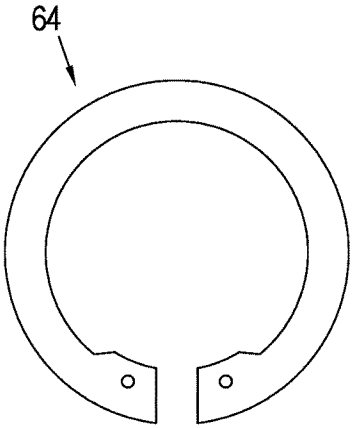
FIG. 6 shows a front view of a clip which is dismountably mountable on the extractor shaft of the tool of FIG. 4.
Figure 7:
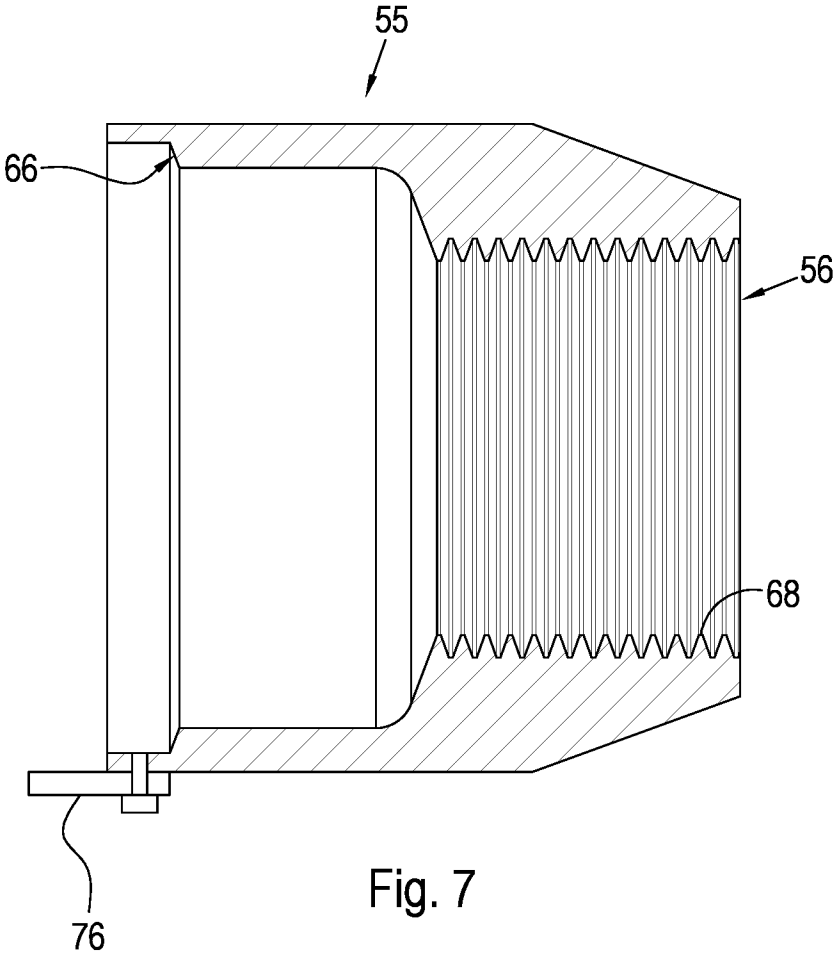
FIG. 7 shows a sectional view of a head engaging member forming part of the tool of FIG. 4.

However, the material which is deflected by the front faces 26, 32 does lead to wear of the head 12. When the wear reaches a maximum desired level, and it is desired to replace the pick sleeve 10 with a new pick sleeve, use is made of a tool which is generally indicated by reference numeral 50 in FIG. 4 of the drawings. With reference also to FIGS. 5 to 7 of the drawings, the tool 50 includes an extractor shaft, generally indicated by reference numeral 52, a connecting arrangement, generally indicated by reference numeral 54, a head engaging member 55 and a displacement arrangement, generally indicated by reference numeral 56.

The extractor shaft 52 has a proximal end 58 and a distal end 60. The extractor shaft 52 is dimensioned such that the distal end 60 can be inserted into the end of the bore 18 opening out of the head 12 such that the proximal end 58 protrudes from the head 12 of the pick sleeve 10 and the distal end 60 protrudes from the free end of the shank 14, i.e. the end remote from the head 12.

The connecting arrangement 54 includes an annular recess 62 which is provided in the extractor shaft 52 adjacent to the distal end 60 such that when the extractor shaft 52 is inserted through the bore of the pick sleeve, the recess 62 is provided in a portion of the shaft which protrudes from the shank 12 adjacent to the end of the shank from which the extractor shaft protrudes. The connecting arrangement 14 further includes a clip 64 which is dismountable mountable in the recess 62 such that it forms an annular shoulder which abuts against the free end of the shank 14.

The head engaging member 55 defines a contact surface 66 which is configured to abut against the front face 32 of the bearing member 22 as illustrated in FIG. 4 of the drawings.

In the embodiment shown, the head engaging member 55 is generally cylindrical in shape and has a female screw-thread 68 on a bore extending therethrough. A portion of the extractor shaft 52 adjacent the proximal end 58 is of increased diameter and has a male screw-thread 70 thereon which is complementary to the screw-thread 68. A drive formation 72 is provided at the proximal end 58 of the extractor shaft 52 which is drivingly engageable by a rotating tool, e.g. a torque multiplier (not shown).

In order to extract the pick sleeve 10 from the holder 18, a pick, if any mounted to the sleeve, is removed. The extractor shaft 52 is then inserted through the bore 18 such that the distal end 60 protrudes from the shank 14. The clip 64 is then mounted in the recess 62 which forms a stop or shoulder which abuts against the free end of the shank 14 and inhibits withdrawal of the extractor shaft 52 from the pick sleeve 60. The head engaging member 55 is then screwed onto the extractor shaft 52 such that the contact surface 66 abuts against the front face 32 of the bearing member 22.

By using a torque multiplier, the extractor shaft 52 is rotated relative to the head engaging member 55 causing relative longitudinal displacement in a direction which urges the extractor shaft 52 in the direction of arrow 74. It will be appreciated that an equal and opposite force will be applied to the head engaging member 55 which will tend to urge the bearing member 22 in a direction opposite to the direction of arrow 74. However, displacement of the bearing member 22 in a direction opposite to the direction of arrow 74 is inhibited by the face 42 of the holder 38 against which it abuts. As the relative rotation between the extractor shaft 52 and head engaging member 55 continues, the bearing member 22 separates from the central part 20 of the head 12 permitting displacement of the pick sleeve 10 except for the bearing member 22 in the direction of arrow 74 and out of the holder 58.

Once the pick sleeve 10 has been removed, a fresh pick sleeve can be inserted into the holder in a conventional fashion.

As illustrated in FIG. 7 of the drawings, a locating finger 76 may be provided on and protrude from the head engaging member 55. The finger abuts against a corresponding formation on the holder 38 which inhibits rotation of the head engaging member 55 and permits relative rotation between the extractor shaft 52 and the head engaging member 55.

It will be appreciated that the face 32 of the bearing member 22 against which the head engaging member abuts need not be frusto-conical in shape. In this regard, different embodiments of the shape of the face 32 are shown in FIGS. 9 to 12 of the drawings.

Figure 12:
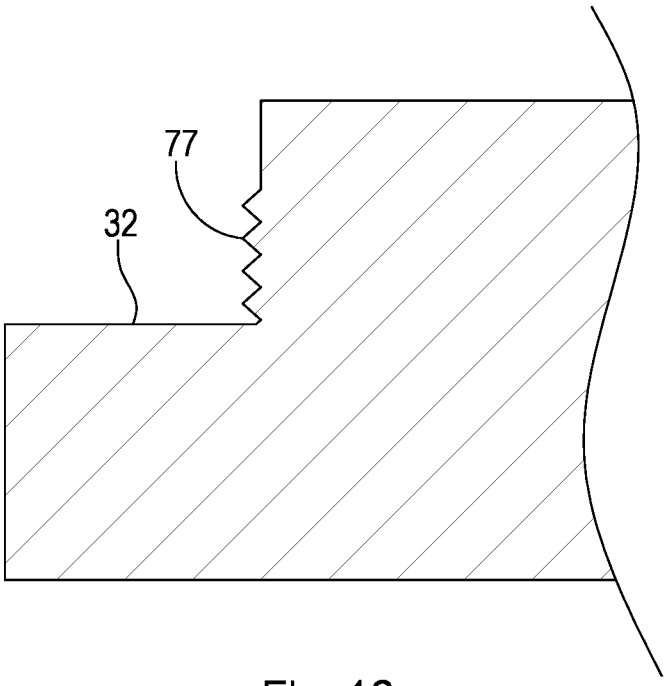

Further, the bearing member 22 need not be a press fit on the central part 20. For example, as illustrated in FIG. 12 of the drawings, the bearing member 12 may be provided with a screw-thread 77 which screw-threadedly engages a complementary screw-thread on the central part 20. When axial loads are applied to the bearing member 22 and the shank 14 in opposite directions, in the manner described above, the screw-threads will strip permitting separation of the bearing member 22 from the central part 20.

In addition, for example, the bearing member 22 and central part 20 may be of unitary construction, i.e. they may be formed of a single piece of material. A zone of weakness, e.g. in the form of annular notch may be provided between the central part 20 and the bearing member 22 which causes material connecting the bearing member 22 to the central part 20 to form a zone of weakness which shears when subjected to a desired axial load.

Figure 13:
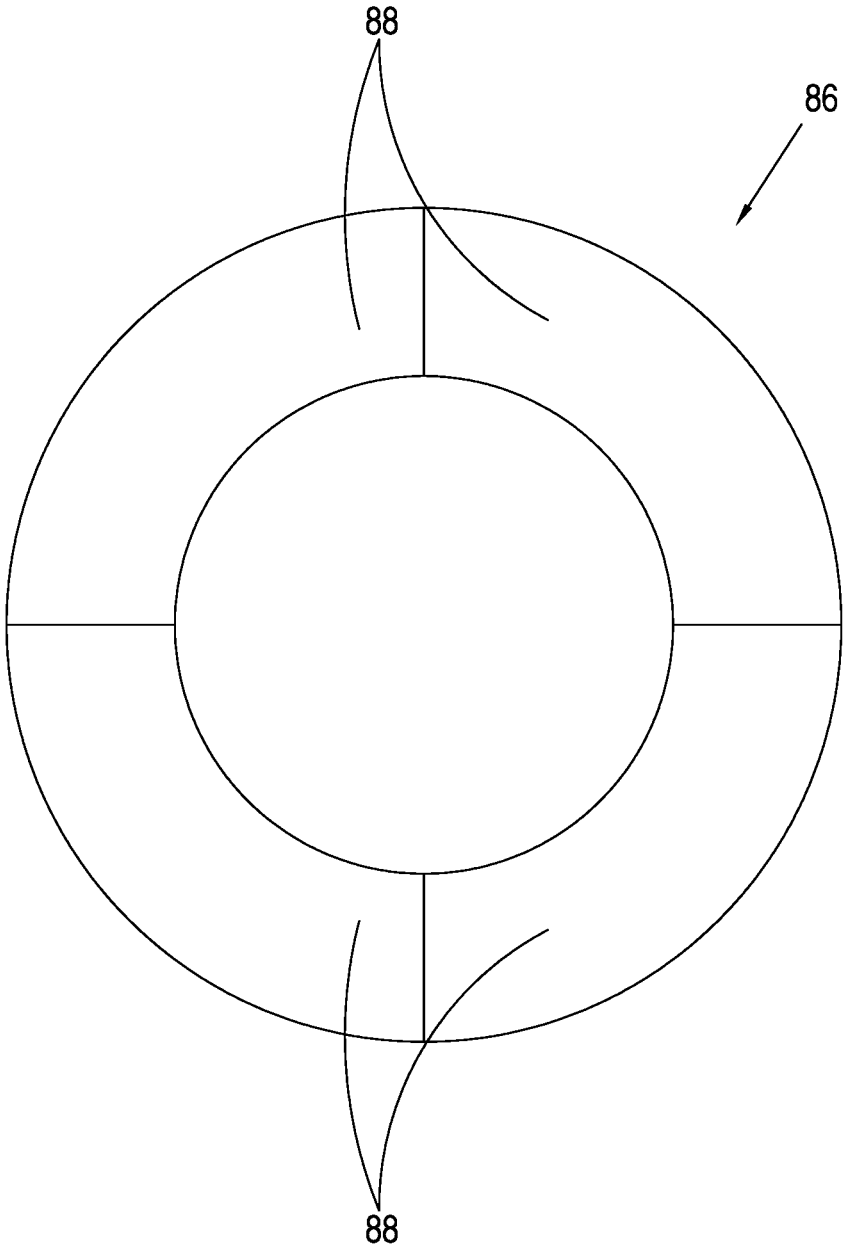
FIG. 13 shows a front view of another bearing ring in accordance with the invention.

In addition, instead of being manufactured from a single piece of material, as illustrated in FIG. 13 of the drawings, the bearing member, generally indicated by reference numeral 86 could be formed in segments 88 which are connected together.

Figure 8:
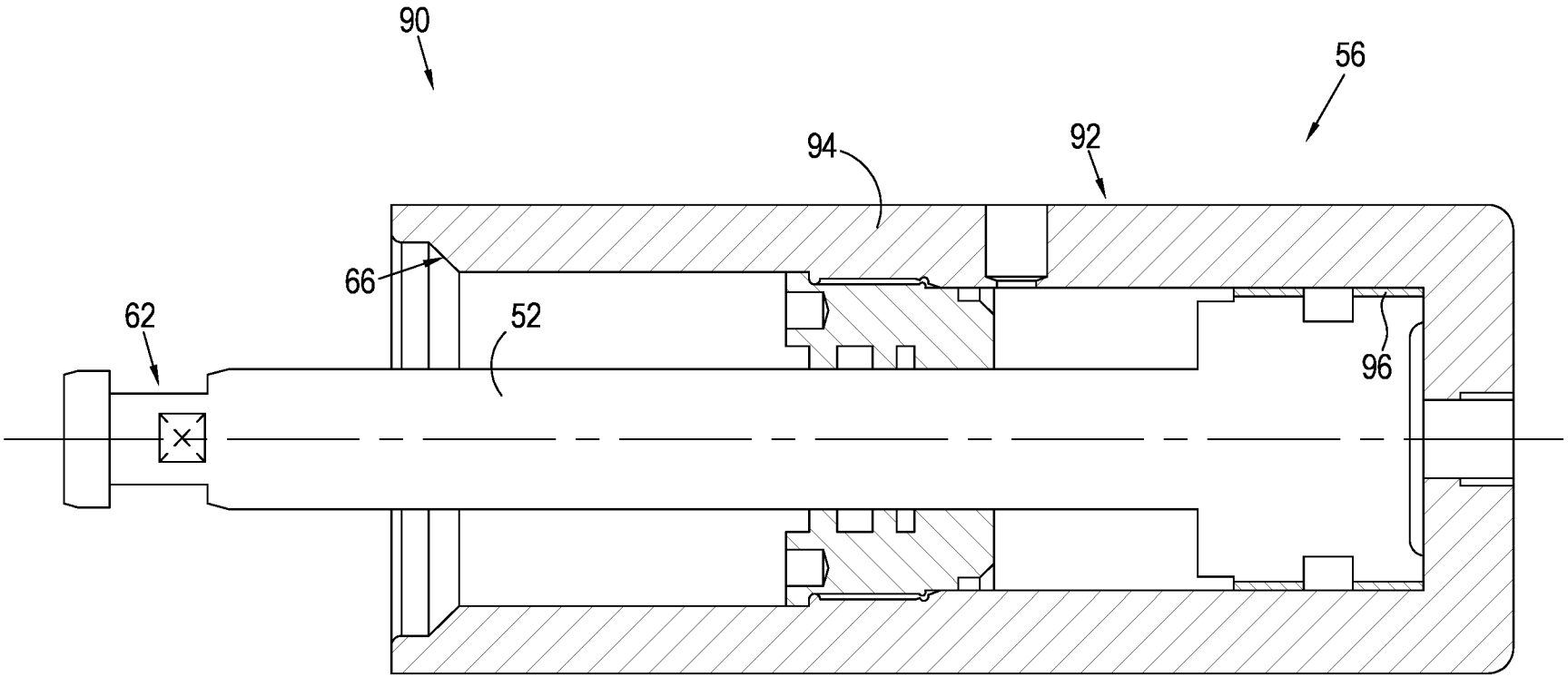
FIG. 8 shows a longitudinal sectional elevation of another tool in accordance with the invention.
Figure 9:
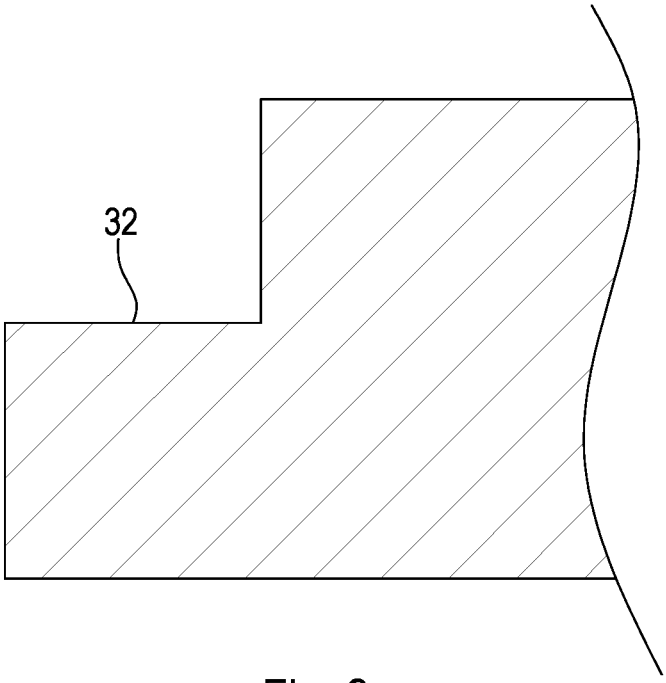
FIGS. 9 to 12 show sectional elevations of parts of other embodiments of the bearing ring.
Figure 10:
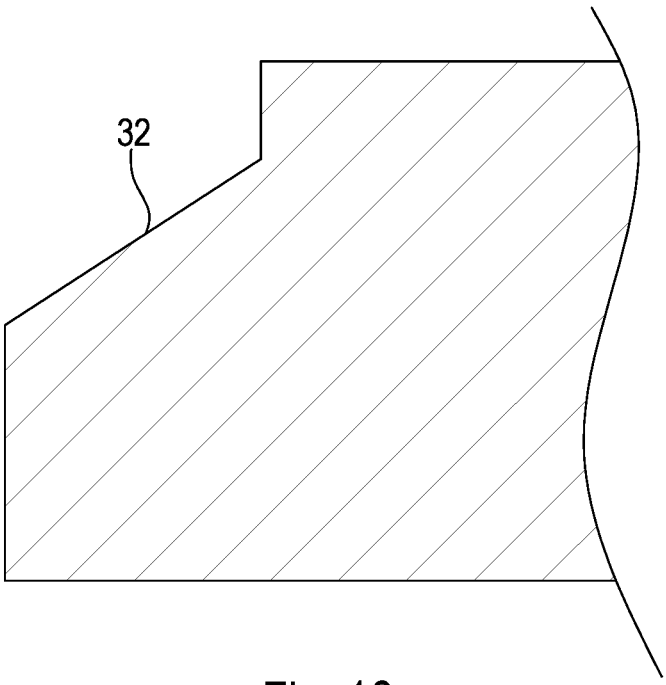
Figure 11:
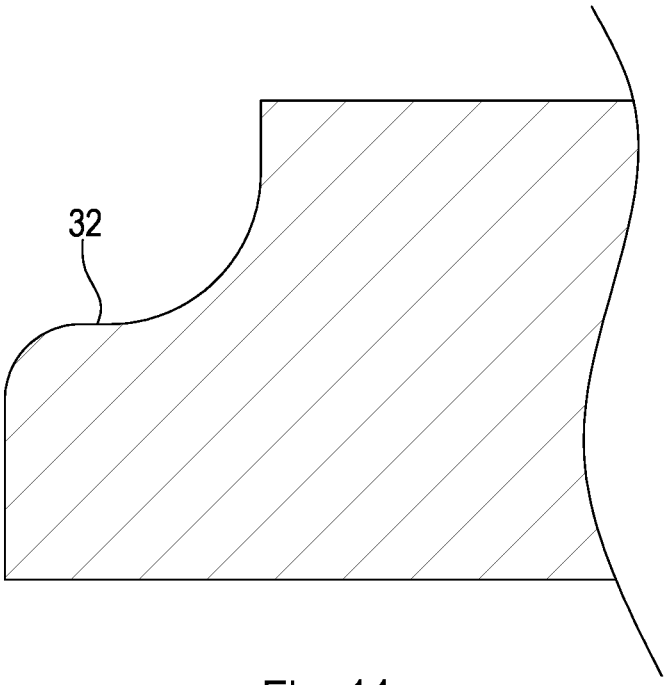

In the embodiment shown in FIG. 8 of the drawings, reference numeral 90 refers generally to another tool in accordance with the invention and, unless otherwise indicated, the same reference numeral used above are used to designate similar parts. In this embodiment, the displacement arrangement 56 includes a hydraulically actuated piston and cylinder arrangement, generally indicated by reference numeral 92. The arrangement 92 includes a cylinder 94 and a piston 96 which is mounted for reciprocation within the cylinder 94. The extractor shaft 52 is connected to the piston 96 such that it protrudes from the cylinder 94. The end of the cylinder 94 from which the extractor shaft 52 protrudes defines the contact surface 66 which abuts against the bearing member 22 in the manner described above.

Hence, in use, in order to extract the pick sleeve 10 making use of the tool 90, the piston 92 is displaced to a fully extended position. The extractor shaft 52 is inserted through the bore 18 and the clip 64 mounted in the recess 62 in the manner described above. In this position, the end of the cylinder 94 defining the contact surface 66 will be in abutment or closely spaced from the bearing member 22. Pressurised hydraulic fluid is then introduced into the cylinder 94 in order to displace the piston 96 towards a retracted position thereby extracting the pick sleeve 10 from the holder 38 in the manner described above.

Figure 14:
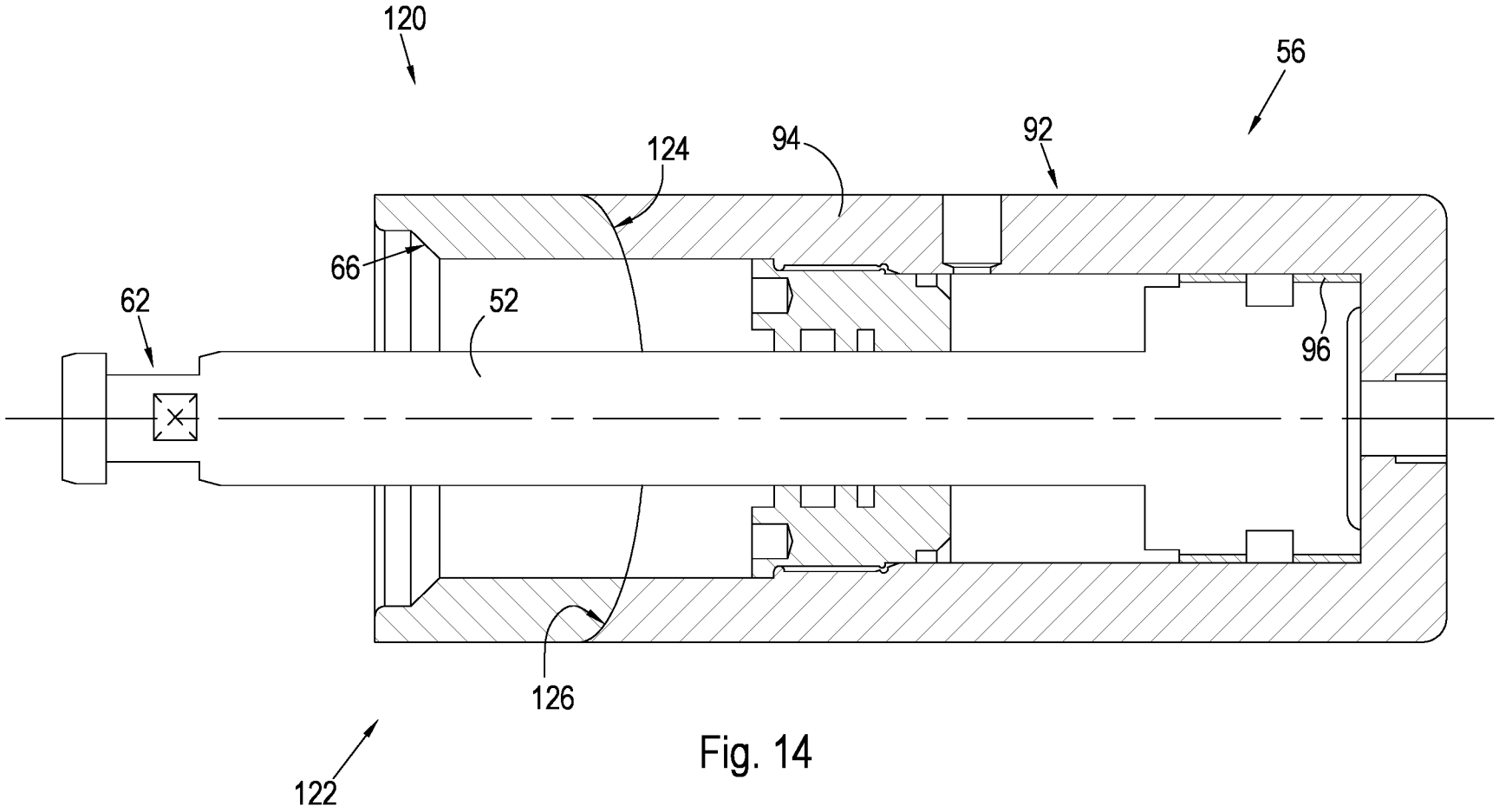
FIG. 14 shows a longitudinal sectional elevation of yet another tool in accordance with the invention.

In another embodiment of the invention shown in FIG. 14 of the drawings, reference numeral 120 refers generally to another tool in accordance with the invention and, unless otherwise indicated, the same reference numerals used above are used to designate similar parts. In this embodiment of the invention, the tool 120, in addition to the hydraulically actuated piston cylinder arrangement 92 includes an intermediate member, generally indicated by reference numeral 122. The intermediate member 122 is open-ended and at one end thereof defines the contact surface 66 which is configured to abut against a bearing ring 22 in the manner described above. An oppositely disposed contact surface 124 is provided at the other end of the intermediate member 120. The end of the cylinder 94 defines a complementary contact surface 126, the contact surfaces 124, 126 typically being part-spherical in shape.

The tool 120 is used in substantially the identical fashion to the tool 90 described above. However, the intermediate member 122 is positioned between the cylinder 94 and the bearing member 22. The provision of the part-spherical contact surfaces 124, 126 permits operation of the tool 120 even if there is slight angular misalignment between the axis of the piston cylinder arrangement and the axis 16.

The Inventors believe that the invention will facilitate the replacement of worn pick sleeves 10 in a cost effective and safe manner.

The invention claimed is:

1. A pick sleeve which includes:

a head which has a front and a rear and which includes a central part having a front face, which tapers towards the front, and a rear face;

a shank which is connected to and protrudes rearwardly from the rear face of the central part of the head and which is receivable in a holder or cutter box of a mining machine as an interference or friction fit; and an open-ended bore extending through the head and the shank within which a shank of a pick is receivable, the head further including a bearing member which has a front face or bearing surface which protrudes laterally beyond the front face of the central part and a rear face which, in use, abuts against a front face of the holder, the bearing member being secured to the central part and being disconnectable therefrom to facilitate removal of the pick sleeve from the holder or cutter box by applying oppositely disposed forces to the shank of the pick sleeve and to the front face of the bearing member which causes the bearing member to separate from the central part of the head and to withdraw the shank from the body of the holder or cutter box.

2. A pick sleeve as claimed in claim 1, in which the central part and the bearing member are formed as separate parts and secured together.

3. A pick sleeve as claimed in claim 2, in which the bearing member is a press-fit on the central part.

4. A pick sleeve as claimed in claim 1, in which the central part of the head and the shank are formed as a unitary construction.

5. A pick sleeve as claimed in claim 1, in which the front face of the central part is frusto-conical and tapers towards a front of the head.

6. A pick sleeve as claimed in claim 5, in which the bearing member is annular and the bearing surface is tapered and extends substantially continuously with and forms an extension of the front face of the central part.

7. A pick sleeve as claimed in claim 1, in which the rear face of the bearing member forms a shoulder which in use abuts against a surface of the holder in which the pick sleeve is mounted.

8. A pick sleeve as claimed in claim 1, in which the rear face of the bearing member and the rear face of the central part lie in a plane which is perpendicular to a longitudinal axis of the pick sleeve and which together form a shoulder which in use abuts against the surface of the holder in which the pick sleeve is mounted.

* * * * *